United States Patent [19]

Bernander et al.

[11] Patent Number: 4,974,380

[45] Date of Patent: Dec. 4, 1990

[54] FRAMING FOR STRUCTURAL WALLS IN MULTISTORY BUILDINGS

[76] Inventors: Karl G. Bernander, Ringvägen 32, S-133 35 Saltsjöbaden; Gunnar Rise, Sälgvägen 1, S-183 40 Täby; Lars-Gunnar Lindberg, Elinshillsvägen 11, S-132 41 Saltsjö-Boo, all of Sweden

[21] Appl. No.: 381,699

[22] PCT Filed: Jan. 15, 1988

[86] PCT No.: PCT/SE88/00007

§ 371 Date: Jul. 14, 1989

§ 102(e) Date: Jul. 14, 1989

[87] PCT Pub. No.: WO88/05484

PCT Pub. Date: Jul. 28, 1988

[30] Foreign Application Priority Data

Jan. 15, 1987 [SE] Sweden ..... 8700147

[51] Int. Cl.[5] ..... E04C 2/46

[52] U.S. Cl. ..... 52/235; 52/236.6; 52/583; 52/587

[58] Field of Search ..... 52/587, 583, 234, 235, 52/236.4, 236.6, 236.7, 236.8, 236.9, 283

[56] References Cited

U.S. PATENT DOCUMENTS

| | | | |
|---|---|---|---|
| 839,272 | 12/1906 | Crow | 52/587 |
| 3,555,763 | 1/1971 | Bloxom | 52/583 |
| 3,696,567 | 10/1972 | Villaneu | 52/587 |
| 3,703,058 | 11/1972 | Klett | 52/583 |
| 3,742,660 | 7/1973 | Bierweiler | 52/587 |
| 3,762,115 | 10/1973 | McCaul | 52/236.6 |
| 3,780,480 | 12/1973 | Cvijanovic | 52/587 |
| 3,785,097 | 1/1974 | Seymour | 52/587 |
| 3,999,398 | 12/1976 | Kurose | 52/587 |
| 4,408,434 | 10/1983 | Collins | 52/745 |

*Primary Examiner*—John E. Murtagh

*Attorney, Agent, or Firm*—Pollock, Vande Sande & Priddy

[57] ABSTRACT

In a frame structure for load carrying facade walls in multistory buildings there is included a concrete element (7) carried by columns and in turn carrying a floor structure. At least one column segment (80) is integrated into the concrete element, and is adapted for connection to at least one supporting column (11).

5 Claims, 5 Drawing Sheets

FRAMING FOR STRUCTURAL WALLS IN MULTISTORY BUILDINGS

FIELD OF THE INVENTION

The present invention generally relates to framing for structural walls in multistory buildings, particularly facade walls. Particularly intended is a floor-carrying, column supported, concrete element which can be included in such framing.

SUMMARY OF THE INVENTION

The object of the invention is, inter alia, to achieve good material economy;

to achieve effective vertical stabilization in the facade plane;

to achieve rapid erection of columns and floor carrying concrete elements with immediate erection stability;

to provide the possibility of very long transportable facade beams;

to provide great freedom of choice in the placement of columns and facade implementation, even in an advanced stage of the project and;

to provide a basis for standards in the efficient prefabrication of facade inner slabs and the insulation and cladding mounted on them.

In carrying out this object, the invention achieves good material economy by utilizing steel columns and by the framing beams being utilized as both inner wall slabs and floor-carrying members;

vertical stabilization in the facade plane by ridged fixing of the columns to the framing beams;

shortened buckling length for the columns, particularly in the facade plane to about, or less than, half a story height and;

confinement of horizontal joints to the upper and under sides of the window opening bands, thus dispensing with the moisture problems in insulation layers, to which, according to experience, horizontal joints at the flooring level are subject in the building stage.

BRIEF DESCRIPTION OF THE DRAWINGS

The invention will be more clearly understood by reading the following description, with reference to the accompanying drawings, in which.

DESCRIPTION OF PREFERRED EMBODIMENTS

Floor-carrying framing or wall elements in accordance with the invention (preferably facade elements) have a substantially flat vertical outer surface, while their inner surfaces can be configured in different ways, inter alia according to the examples described below, preferably so that the lower part of the element is thickened to provide support for the flooring. Typical values for the ratio between the height of the facade element and its greatest width fall in the range of 1:5 to 1:8. The concrete facade elements must be provided with steel connection means anchored in the concrete for connection to the columns, and the examples illustrate a plurality of solutions for achieving this. It is important that the facade elements can be easily erected on the columns. A plurality of locating and bearing means is illustrated in the examples, for the purpose of giving immediate erection stability, which can then be supplemented by welding and/or injection joints.

Figures 1, 1A:
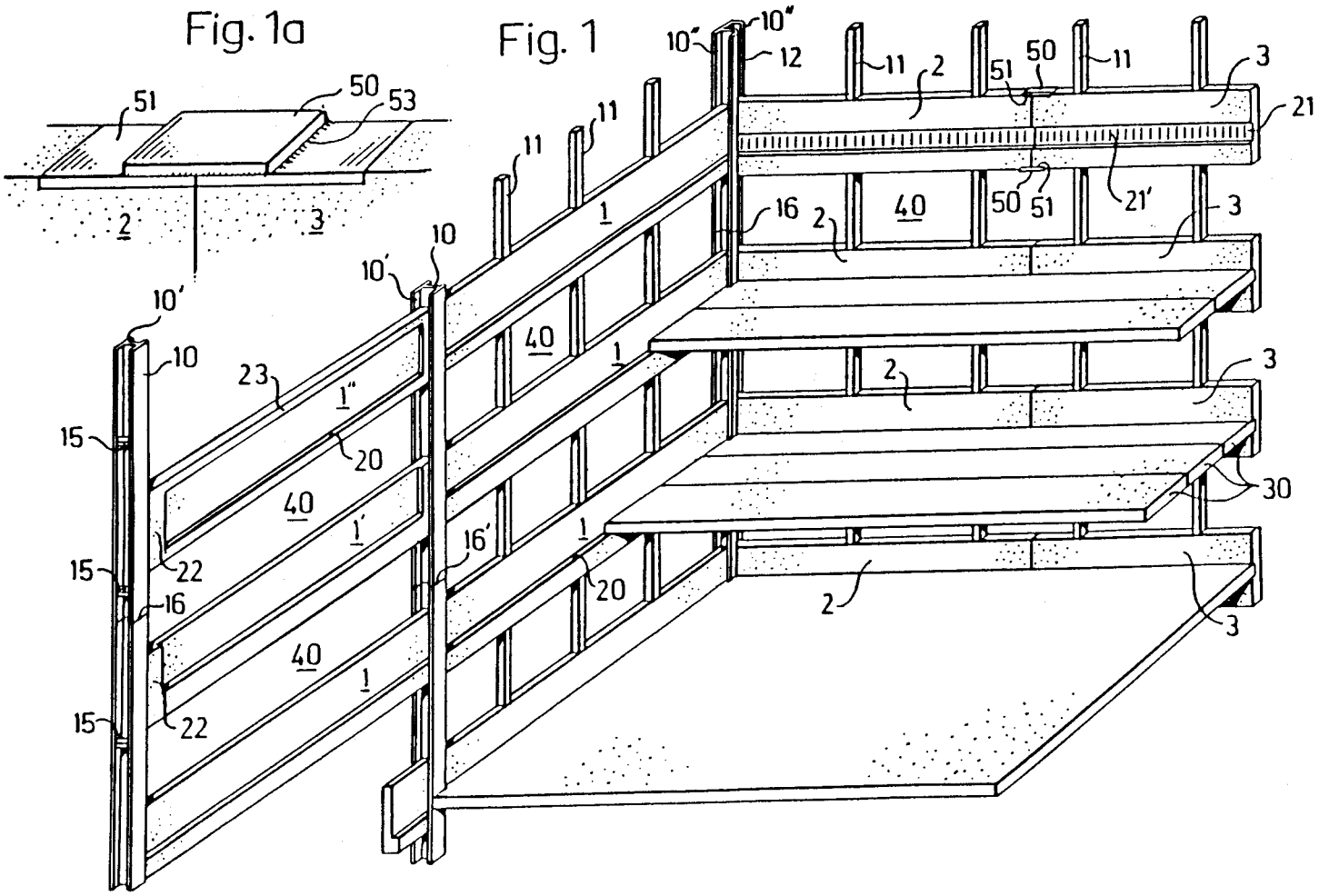
FIG. 1 is a schematic perspective view from the inside of a building during the building stage, utilizing the principles of the invention.
FIG. 1*a* is a fragmentary, enlarged detail of a joint which can be seen in FIG. 1.

FIG. 1 illustrates framing combined from facade elements 1, 2, 3 and steel columns 10, 11, 12, partly in a facade portion of a multistory building (to the left in the figure), and partly in an end wall portion (to the right in the figure) of the same building. The facade elements 1, 1', 1'' in the facade have bearing surfaces 20 for prefabricated flooring elements 30, and the facade elements in the end wall portion of the building have a longitudinal recess at flooring level for connection to the flooring structure 30 for shear force transmission, this recess suitably being arranged with vertical indentations 21'. The facade elements can be arranged with thickened end portions 22 and/or with a single-sided inwardly facing upper flange 23 (see also FIG. 2). The facade elements 1, 1', 1'' are made integrally and are defined in height by the window opening bands 40 in the stories above and below the flooring carried by the facade elements, and laterally by the RSJ columns 10 and/or 12, which have their flanges 10' disposed in the plane of the facade element. There are brackets 15 on the columns 10 for the facade elements 1, 1', 1'' which, although not illustrated in the drawings, are rigidly connected to the columns 10 and 12. The columns 10 are two storeys in height, and adjacent columns are jointed at 16 and 16' in separate stories just above the upper surfaces of the facade elements 1, 1', 1'', such that the brackets 15 do not obstruct the erection of the facade elements. As required, the column support at the ends of the facade elements is supplemented by intermediate steel columns 11, which are rigidly connected in the upper and lower facade elements 1. The facade element 2 in the end wall, which is connected to intermediate columns 11, has one end connected to a special corner column 12 with flanges 10'', this column being composed of two steel channels. At its other end, the facade element 2 is directly connected to a meeting element without a column, using a welded joint (at 53) with fish plates 50 which are welded to steel plates 51 (FIG. 1*a*) cast into and anchored in the upper and lower ends of the respective element 2 and 3. The elements 3 are exclusively supported by the columns 11.

Figure 2:
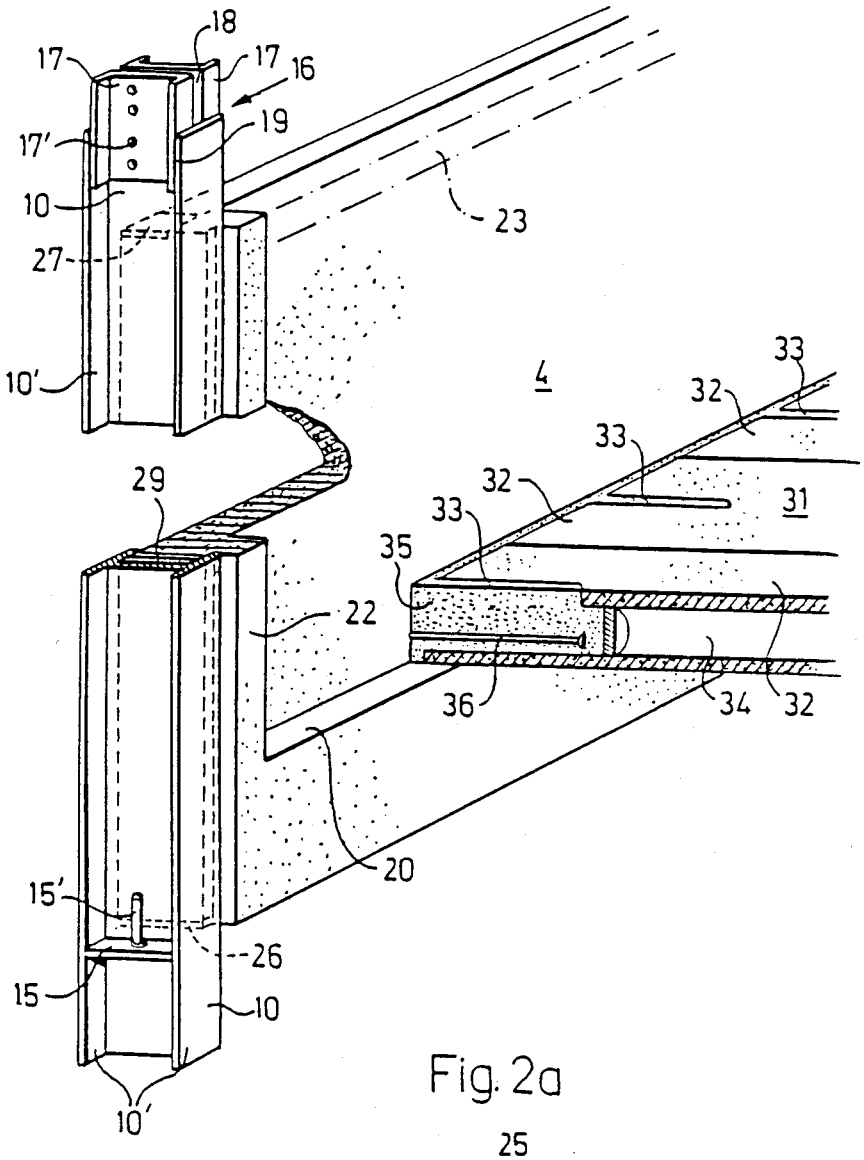
FIG. 2 is a partially sectioned perspective view, to a larger scale, of a detail in one type of framing in accordance with the invention.

FIG. 2 illustrates a facade element 4 with a bearing surface 20 carrying a flooring structure 31 comprising several elements 32 whose ends are provided with slots 33 over some of the hollows 34 in which connection means 36, anchored in the facade element 4, are anchored to the floor structure 31 by grouting 35. The element 4 has an end stiffening 22, and optionally a single-sided upper flange 23. At its ends it has a thickness 25 which is somewhat less than the distance between the insides of the flanges 10' of the columns 10, 12. In addition, the element is provided at each end with a lower plate 26 and an upper plate 27 anchored in the concrete for connection, e.g., by welding, between the lower plate 26 and a bearing plate 15 on the column, and with a plate between the upper connection plate 27 and the web and/or flanges 10' of the column 10, respectively. The vertical gap 29 between the end wall surface of the facade element 4 and the webs of the columns 10 can suitably be filled with grouting, with the object of providing a sealed connection and direct transmission of horizontal compression forces through the column web between two facade elements connected to a column. At the top of the column 10, there is a joint 16 comprising two channels 17 with holes 17' for a friction bolt joint against the web of the column 10, these channels 17 forming a location 18 for erecting an upper column section (not shown). After erection, the friction bolt joint is suitably supplemented by welding between the flanges 10' of the erected column 10 and the flanges of the channels 17.

Figure 2A:
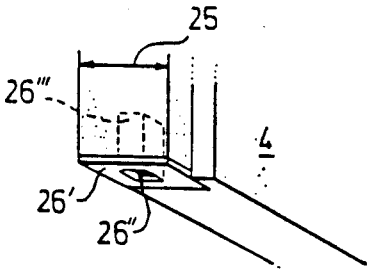
FIG. 2*a* illustrates an alternative detail implementation of a facade element bearing.

FIG. 2*a* illustrates a lower corner portion of the facade element 4 of FIG. 2, with the bearing plate 26 implemented by a hole 26' and a recess 26'' in the concrete above it. The recess 26'' is disposed for accomodating the dowel 15' on the bracket 15 attached to the column 10. This dowel connection gives immediate erection stability, and a later stage it can be made force-transmitting by the injection of a hardening composition.

Figure 3:
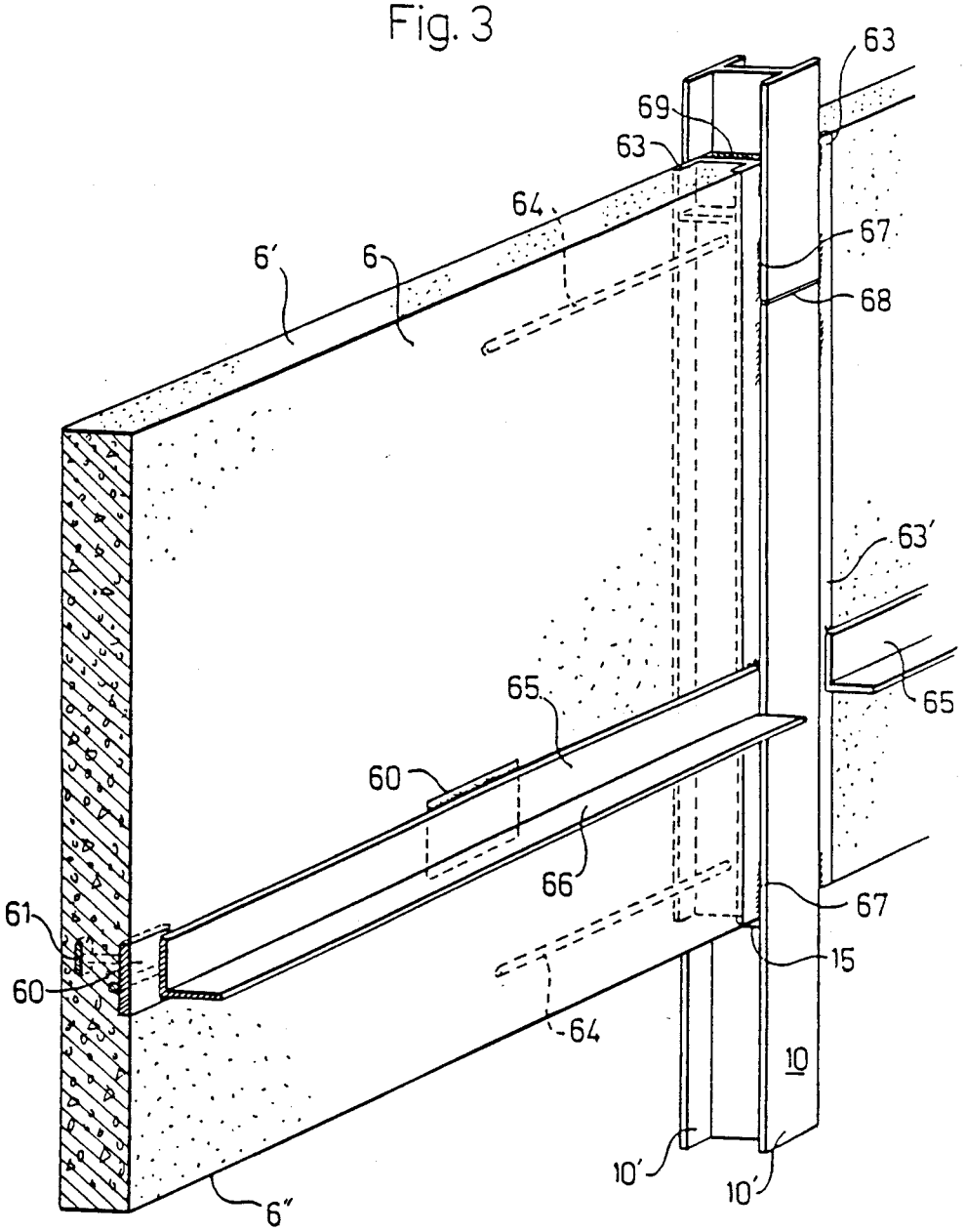
FIG. 3 illustrates, in a similar way, a detail of another type of framing in accordance with the invention.

FIG. 3 illustrates a facade element 6 which mainly comprises a flat concrete slab containing upper and lower zone, reinforcements (not shown) so that it can be regarded as a high beam. In the element 6 there is a series of fixing plates 60 provided with anchoring means 61 and spaced in a row, the exterior surfaces 62 of the plates being flush with the facade element inner surface. The ends of the element 6 are defined by steel channel sections 63, which have also served as form work during manufacture and are connected to reinforcement rods 64. A steel angle 65 has been welded to the fixing plates 60 and the flanges 63' of the channels 63, a surface 66 of the angle serving as bearing for preferably prefabricated simply supported flooring elements.

The facade element 6 is fitted in between the flanges 10' of the columns 10 and bears on brackets 15 on the columns. After the flanges 10' of the columns have been connected to the channel flanges 63' by means of welds 67, the facade element 6 together with associated columns 10 forms a rigid frame. In the example, it has been indicated that the column 10 has a joint 68 at a distance below the upper defining surface 6' of the element 6. For achieving good sealing, also in connections between column and facade element, the space between the end wall of the facade element and the column web may be injected with grout 69.

Figure 4:
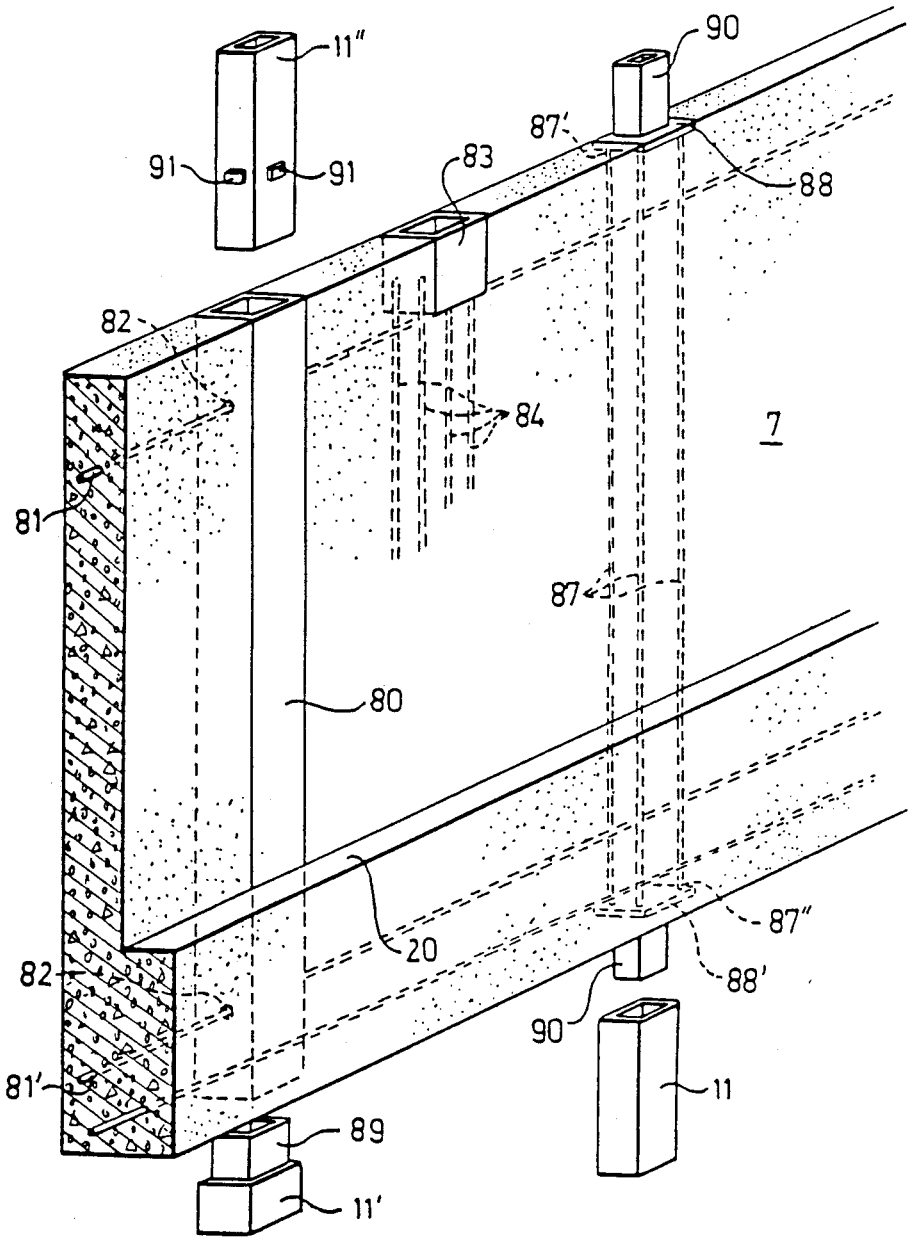
FIG. 4 is a perspective view of a part of a facade element with column connections.

FIG. 4 illustrates a column segment 80 in the form of a steel hollow beam which has the same height as a facade element 7 and is cast into the element such as to have two free surfaces, which coincide with the free surfaces of the facade element, at least at its upper part. The segment 80 coacts with the concrete portions of the facade element with the aid of main reinforcement 81, which passes through holes 82 in the segment. In an alternative embodiment, the central portion of the segment is replaced by reinforcement rods 84, which are welded for stress transmission to the remaining ends 83 of the segment. The figure also illustrates a third alternative, where the segment in its entirety has been replaced by reinforcement rods 87, the upper ends 87' of which are connected to a support plate 88 and the lower ends 87'' of which are connected to support plate 88', the outer surfaces of these plates being flush with that of the concrete. The facade element 7 is erected on columns 11 and 11', which are column segments connected to an underlying facade element (not shown). On the column segment 11' is attached a location plug 89, which is congruent with and somewhat smaller than the internal dimensions of the column segment 80. In a similar way, there are location plugs 90 connected to the plate 88 and 88' such that the plugs are accommodated in the segment 11. After the element 7 has been erected on the column segments 11, there is immediate erection stability in the plane of the element, after which the joint can be supplemented by welding between the lower end surfaces of the segment 80 and/or the plate 88' and the end surfaces of the stud segment 11, thus producing a stiff frame. In the continued erection, the cross section of the stud segment 11' can be reduced to that of the segment 11''. The segment 11'' has projections 91 for bearing against the top surface of the cast-in segment 80 when the segment 11'' is erected, the joint being supplemented by welding between the top surface and the walls of the segment 11'.

Figure 5:
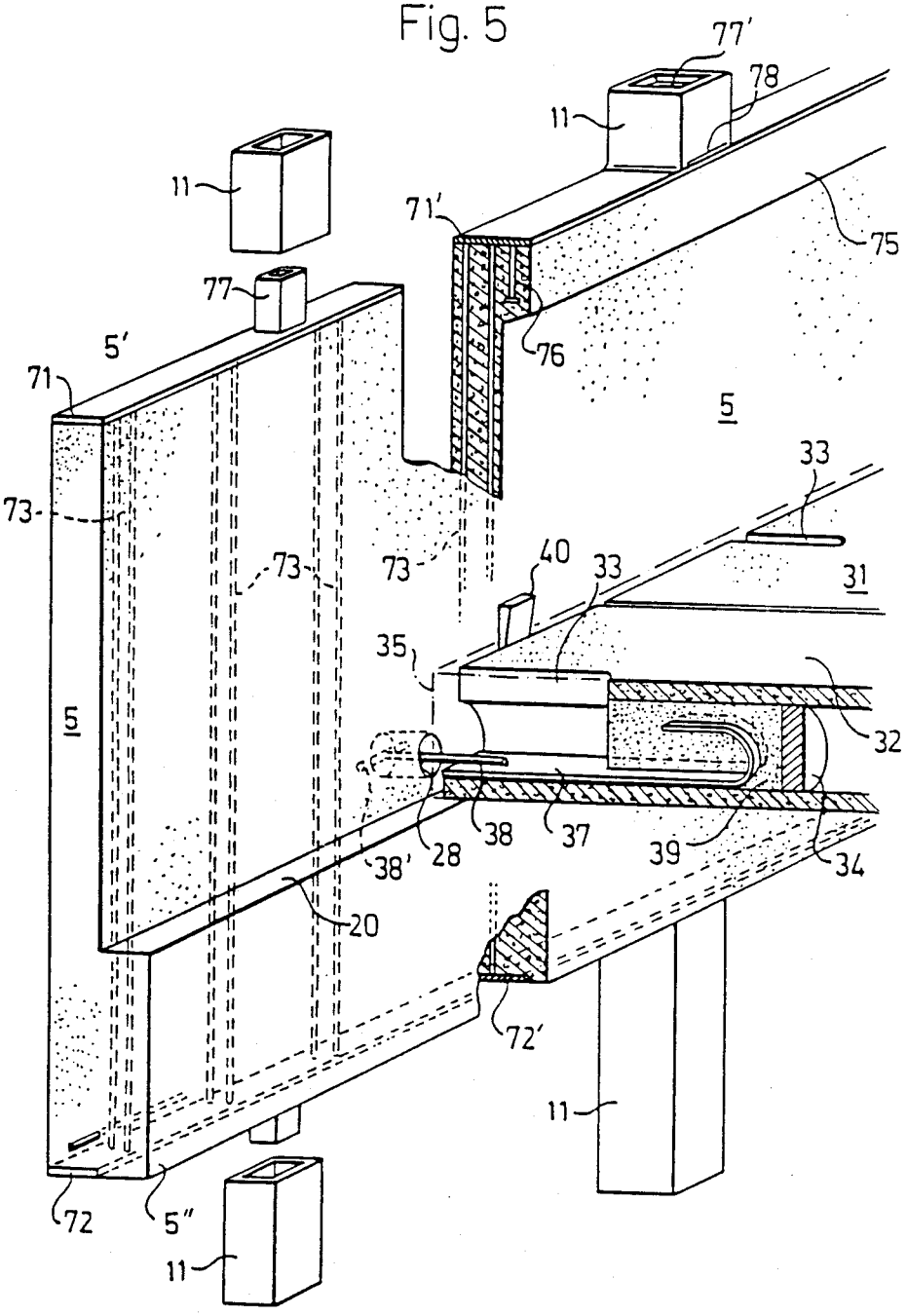
FIG. 5 is a partially sectioned perspective view of a facade element in accordance with the invention with another form of column connection.

FIG. 5 illustrates a facade element 5 with a bearing surface 20 for the floor structure 31. The upper surface 5' and the lower surface 5'' of the facade element are defined by steel flats 71 and 72 which are mutually connected by reinforcement rods 73 so as to form uninterrupted columns in the element together with the concrete thereof. The flats 71 and 72 form the beam reinforcement of the element 5, which can be supplemented by further reinforcement, however. As required, the facade element 5 can be provided with a single-sided inwardly facing upper flange 75, the flat 71 being provided with anchoring means 76. The flats 71 and 72 serve as basis for location blocks 77 connected by internal welds to the flats at optional spacing. The column segment 11, here a square hollow beam, has a length corresponding to the height of a window opening band in a frame, i.e., the distance between the defining surfaces 5' and 5'' in two facade elements situated one above the other, and on erection the column segments 11 are fitted over location blocks 77 on the facade element 75, the exterior cross-sectional dimensions of the blocks being congruent with the hollow cross-section of the segments 11. Immediate erection stability is thus obtained, until a suitable time for making the welded joints 78 between the segments 11 and flats 71 and 72, resulting in a stiff composite framework between studs 11 and facade elements placed one above the other.

A single-span floor structure 31 comprising extruded, prestressed, hollow elements 32 is carried at one end on the bearing surface 20. Above some of the hollows 34 in at least a plurality of the elements 32, there is an upwardly open slot 33. Under the slot and close to the bottom of the hollow there is a flat 37 with one end turned over, this flat being anchored in the hollow 34 by cast-in concrete 39. A round rod 38 has been welded to the upper side of the flat 37, after it has been taken passed through the vertical, oval hole 28 in the facade element and turned so that its anchoring means 38' engages against the outer surface of the element. Using a wedge 40, driven in between the inner surface of the element 5 and the end of the flooring element 32, the connection means 38 and 37 are tensioned so that torque from the bearing reaction of the floor structure 31 at the bearing surface 20 can already be balanced by coaction between the flooring element 31 and the facade element, before the slot 33 and the vertical joint between flooring structure and facade element has been filled with hardening casting composition 35.

A difficulty in the application of the invention is the minor torsional stiffness of the facade elements in erecting the floor structures. The embodiment of the invention illustrated in FIG. 5 indicates a method of obtaining immediate torsional stiffness already in conjunction with erection. The illustrated connection can be achieved without the aid of grouting by there being a steel connection means cast into, and anchored in the hollows of the floor structure. Of course, this connection means can be connected to other types of connections arranged in the facade elements, e.g., fixing plates, steel bearing means, steel struts, etc.

The flooring structures are preferably prefabricated, suitably extruded hollow floor elements, at present fabricated in spans of between 5 and 20 meters and with depths varying between 15 cm and 40 cm, or prestressed ribbed elements of the TT-type.

We claim:

1. A structural frame for a multi-story building comprising horizontally extending, floor carrying spandrel means having a top surface and a bottom surface and vertical outer and inner side surfaces, and vertically extending column means, said spandrel means having integrated therein at least one column section vertically extending from said top surface to said bottom surface, and further including connection means adapted for connection of said column means to said spandrel means, said column means having a length corresponding to the height of a window opening of said building and being connectable by means of said connection means to said spandrel means so as to extend in a vertical direction of said column section from said top surface of a first spandrel means to said bottom surface of a second spandrel means to support said second spandrel means.

2. A structural frame according to claim 1, wherein said spandrel means includes a horizontally extending recess in said inner side surface for receiving and supporting a flooring slab.

3. A structural frame according to claim 1, wherein said inner side surface includes a stepped portion providing a supporting surface for a flooring slab.

4. A structural frame according to claim 1, wherein a first end of said spandrel means is additionally supported by a column of said building, said column having a length corresponding to the height of at least two stories of said building.

5. A structural frame according to claim 1, wherein first and a second ends of said spandrel means are additionally supported by columns of said building, said columns having a length corresponding to the height of at least two stories of said building.

* * * * *